US006284369B1

(12) United States Patent
Kume et al.

(10) Patent No.: US 6,284,369 B1
(45) Date of Patent: Sep. 4, 2001

(54) SHEET FOR FORMING BURNED PATTERN

(75) Inventors: Katsuya Kume; Yutaka Tosaki; Hidetoshi Itou; Katsuyuki Okazaki; Mitsuo Kuramoto, all of Osaka (JP)

(73) Assignee: Nitto Denko Corporation, Osaka (JP)

( * ) Notice: Subject to any disclaimer, the term of this patent is extended or adjusted under 35 U.S.C. 154(b) by 0 days.

(21) Appl. No.: 09/194,872

(22) PCT Filed: Jun. 10, 1997

(86) PCT No.: PCT/JP97/01997

§ 371 Date: Dec. 4, 1998

§ 102(e) Date: Dec. 4, 1998

(87) PCT Pub. No.: WO97/48086

PCT Pub. Date: Dec. 18, 1997

(30) Foreign Application Priority Data

Jun. 10, 1996 (JP) ..... 8-171880
Jan. 17, 1997 (JP) ..... 9-019785

(51) Int. Cl.[7] ..... G09F 3/02; G09F 3/10

(52) U.S. Cl. ..... 428/355 AC; 428/343; 428/354

(58) Field of Search ..... 428/343, 354, 428/355 AC; 156/89.11

(56) References Cited

U.S. PATENT DOCUMENTS

Re. 24,906 * 12/1960 Ulrich ..... 428/355 AC
5,008,151 * 4/1991 Tominaga et al. ..... 428/343
5,089,071 * 2/1992 Tominaga et al. ..... 156/89

FOREIGN PATENT DOCUMENTS 0 306 727 A 3/1989 (EP) .
0 402 946 A 12/1990 (EP) .
0 570 926 A 11/1993 (EP) .
92005258 * 7/1985 (JP) .
5-9448 1/1993 (JP) ..... C09J/131/04
6-337634 12/1994 (JP) ..... G09F/3/02

OTHER PUBLICATIONS

International Search Report

* cited by examiner

*Primary Examiner*—Daniel Zirker
(74) *Attorney, Agent, or Firm*—Sughrue, Mion, Zinn, Macpeak & Seas, PLLC

(57) ABSTRACT

A sheet for forming a burned pattern is provided which comprises a ceramic green sheet layer (1) to be burned and a pressure-sensitive adhesive layer (2), wherein the pressure-sensitive adhesive layer comprises either a single layer decomposable at low temperature and leaving a decreased amount of carbonaceous residues after burning or a laminated layer comprising at least two layers of an inner pressure-sensitive adhesive layer (21) which is the low-temperature-decomposable layer and an outer pressure-sensitive adhesive layer (22) having resistance to water washing.

The pressure-sensitive adhesive layer of the sheet for forming a burned pattern shows excellent provisional adhesion to adherends before burning. In particular, the outer pressure-sensitive adhesive layer shows such adhesive strength that the sheet is prevented from peeling off upon water washing. Even when the ceramic green sheet layer is one formed by a conventional manner, the pressure-sensitive adhesive layer disappears at lower temperature during burning the green sheet layer while showing satisfactory thermal decomposability. The sheet for forming a burned pattern as a whole is thus less apt to leave carbon, tar, etc.

5 Claims, 1 Drawing Sheet

SHEET FOR FORMING BURNED PATTERN

TECHNICAL FIELD

The present invention relates to a sheet for forming a burned pattern, which has a pressure-sensitive adhesive layer with excellent disappearance property and is excellent in color retention, adhesion after burning, etc.

BACKGROUND ART

A sheet for forming a burned pattern comprising a ceramic green sheet and a pressure-sensitive adhesive layer formed thereon has been known (Examined Japanese Patent Publication No. 4-5258). This sheet is intended to be used in such a manner that information, e.g., a pattern, is imparted to the ceramic green sheet with a heat-resistant ink to form a label or the like and this sheet is provisionally bonded to an adherend through the pressure-sensitive adhesive layer and then burned.

As a result of the burning treatment, organic components such as an organic binder or a pressure-sensitive adhesive layer disappear and the ceramic green sheet becomes a burned object which is tenaciously adhered as a burned label to an adherend. Consequently, such a sheet for forming a burned pattern is suitable for use in, for example, forming a burned label having high durability, high heat resistance, etc., and can be advantageously used for, for example, controlling a production system in which many kinds of finished products, semifinished products, or parts each made of a metal, glass, burned ceramic, or the like are produced in small quantities.

However, the conventional sheet for forming a burned pattern had a problem that where the sheet is provisionally bonded to a glass product, e.g., a Braun tube, and baked by burning to give a burned label, etc., carbonaceous residues such as tar or carbon remain in a large amount, thereby decreasing the degree of coloration of the burned label, etc. The decrease in the degree of coloration particularly becomes the problem in the case that it is intended to impart a contrast of, e.g., white. Further, there has been another problem that the carbonaceous residues generate at the interface with an adherend and constitute a weak boundary layer, thereby decreasing the adhesion of the burned label or the like to the adherend.

An object of the present invention is to develop a sheet for forming a burned pattern which contains a small amount of carbonaceous residues due to burning treatment and can form a burned label or the like having, for example, excellent retention of a colored state, e.g., whiteness, and adhesion after burning to the adherend.

There is another problem that when the above-described sheet for forming a burned pattern is provisionally bonded to an adherend made of, e.g., a ceramic and then washed with water, that is, in the step for producing Braun tubes or the like, washing with water is conducted before applying a fluorescent substance, but in such a case, if the sheet for forming a burned pattern is washed with water without conducting preburning, water penetrates into the bonding interface to cause the sheet to peel off. Although such a problem can be avoided when the sheet for forming a burned pattern is preburned, there is a strong desire for elimination of the necessity of preburning in order to improve the production efficiency of Braun tubes or the like.

DISCLOSURE OF THE INVENTION

During intensive investigations in order to overcome the problems described above, the present inventors elucidated that an organic binder and a pressure-sensitive adhesive layer account for most of the organic components causative of carbonaceous residues such as tar and carbon. The inventors repeatedly made various investigations on these organic components and have found unexpected results that if a pressure-sensitive adhesive layer decomposable at low temperature is used, even if an organic binder which has been causative of carbonaceous residues such as tar and carbon is used, generation of such residues can be prevented. Namely, the detailed reasons are not clear, they have succeeded in preventing generation of carbonaceous residues attributable to an organic binder by using a pressure-sensitive adhesive layer decomposable at low temperature, thereby inhibiting the sheet as a whole from generating carbonaceous residues. The present invention has thus been achieved.

A first invention of the present invention is to provide a sheet for forming a burned pattern, comprising a ceramic green sheet layer to be burned and a pressure-sensitive adhesive layer, wherein the pressure-sensitive adhesive layer is decomposable at low temperature and leaves a decreased amount of carbonaceous residues after burning.

A second invention of the present invention is to provide a sheet for forming a burned pattern, comprising a ceramic green sheet layer to be burned and a pressure-sensitive adhesive layer, wherein the pressure-sensitive adhesive layer is formed from a laminated layer comprising at least two layers of an inner pressure-sensitive adhesive layer which is decomposable at low temperature and leaves a decreased amount of carbonaceous residues after burning and an outer pressure-sensitive adhesive layer having resistance to water washing.

According to the first invention, a sheet for forming a burned pattern can be obtained which as a whole is less apt to leave tar, carbon, etc. because even when the ceramic green sheet layer is formed by a conventional manner, the pressure-sensitive adhesive layer disappears at lower temperature during burning the green sheet layer while showing good thermal decomposability, and which satisfactorily retains a colored state, e.g., whiteness, because of the decreased stain by carbonaceous residues, and has excellent adhesion after burning to the adherend. Furthermore, the pressure-sensitive adhesive layer before burning is also excellent in provisional bonding to adherends.

According to the second invention, a sheet for forming a burned pattern can be obtained in which the pressure-sensitive adhesive layer before burning is excellent in provisional bonding to adherends, in particular the outer pressure-sensitive adhesive layer shows such adhesive strength that the sheet is prevented from peeling off upon washing with water, and which as a whole is less apt to leave carbon, tar, etc. because even when the ceramic green sheet layer is one formed according to the conventional manner, the pressure-sensitive adhesive layer disappears at lower temperature during burning the green sheet layer while showing satisfactory thermal decomposability, and which satisfactorily retains a colored state, e.g., whiteness, because of the decreased strain by carbonaceous residues and comes to have excellent adhesion to the adherend through burning.

BEST MODES FOR CARRYING OUT THE INVENTION

The sheet for forming a burned pattern according to the first invention comprises a ceramic green sheet layer to be burned and a pressure-sensitive adhesive layer, wherein the pressure-sensitive adhesive layer is decomposable at low temperature and leaves a decreased amount of carbonaceous residues after burning.

Figure 1:
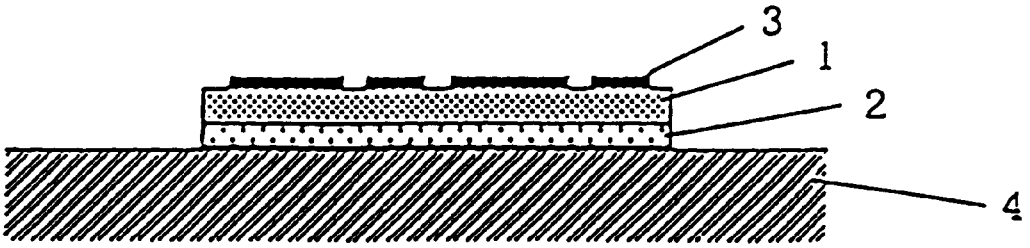
FIG. 1 is a sectional view showing one embodiment of the sheet for forming a burned pattern according to the first invention.

An example thereof is shown in FIG. 1, wherein 1 is a ceramic green sheet layer and 2 is a pressure-sensitive adhesive layer. The Figure shows a label to be burned, which has a pattern imparted to the ceramic green sheet layer 1 and has been provisionally bonded to an adherend. 3 is a pattern layer and 4 is the adherend.

The sheet for forming burned pattern according to the second invention comprises a ceramic green sheet layer to be burned and a pressure-sensitive adhesive layer, wherein the pressure-sensitive adhesive layer comprises a laminated layer of an inner pressure-sensitive adhesive layer which is decomposable at low temperature and leaves a decreased amount of carbonaceous residues after burning and an outer pressure-sensitive adhesive layer having resistance to water washing.

Figure 2:
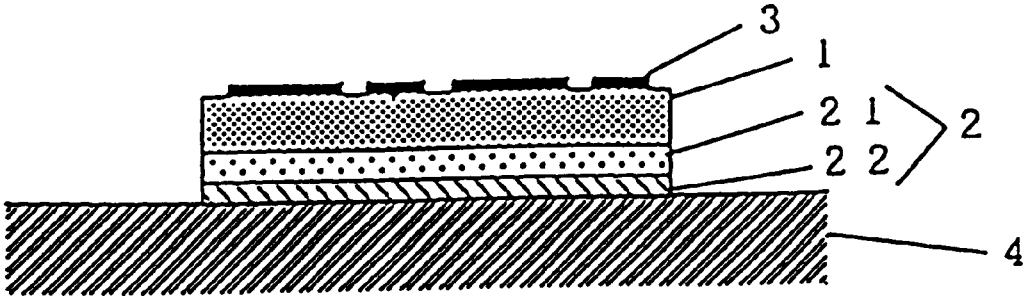
FIG. 2 is a sectional view showing one embodiment of the sheet for forming a burned pattern according to the second invention.

An example thereof is shown in FIG. 2, wherein 1 is a ceramic green sheet layer, 2 is a pressure-sensitive adhesive layer, 21 is an inner pressure-sensitive adhesive layer, and 22 is an outer pressure-sensitive adhesive layer. The Figure shows a label to be burned, which has a pattern imparted to the ceramic green sheet layer 1 and has been provisionally bonded to an adherend. 3 is a pattern layer and 4 is the adherend.

The sheet for forming a burned pattern of the present invention is not particularly limited except for the pressure-sensitive adhesive layer, the inner pressure-sensitive adhesive layer, and the outer pressure-sensitive adhesive layer. The ceramic green sheet layer, sheet constitution, and the like may be in accordance with conventional techniques, e.g., those described in Examined Japanese Patent Publication No. 4-5258. Consequently, the ceramic green sheet layer can, for example, be obtained as a sheet-form shape or the like by mixing an organic binder which upon burning disappears through pyrolysis, etc. with one or more inorganic powders with the aid of an organic solvent, etc. by means of a ball mill or the like, spreading the mixture on a substrate, e.g., a separator, by an appropriate technique, e.g., the doctor blade method, and drying the spread mixture.

Examples of the inorganic powders include powdery glasses for bonding to adherends through burning, such as lead glasses, lead borosilicate glasses, soda glasses, and various frits, white or other pigments or fillers for coloring the sheet, such as silica, calcium carbonate, titanium oxide, zinc white, zirconia, calcium oxide, alumina, and potassium titanate, and powdery or fibrous materials for controlling sheet properties, etc. which are made of a ceramic, metal (alloy), or the like having a melting point higher than the burning temperature. Such inorganic powders can be used in an appropriate combination according to need.

Examples of the organic binder include plastics such as hydrocarbon, vinyl, styrene, acecarbon, butyral, acrylic, polyester, urethane, and cellulosic polymers and various waxes such as paraffinic, natural, ester, higher-alcohol, and higher-amide waxes. Such organic binders can be used in an appropriate combination according to need.

Although the thickness of the ceramic green sheet layer is suitably determined according to the intended use, etc., it is generally 10 to 500 $\mu$m, especially from 30 to 100 $\mu$m. If desired and necessary, the ceramic green sheet layer may be formed as a composite with a reinforcing substrate, e.g., a glass cloth, a laminate with a plastic film which burns off, or the like.

The pressure-sensitive adhesive layer may be a single layer comprising a pressure-sensitive adhesive substance decomposable at low temperature. Alternatively, it may be formed from a laminated layer of at least two layers of an inner pressure-sensitive adhesive layer in contact with the ceramic green sheet layer and an outer pressure-sensitive adhesive layer having resistance to water washing so as to inhibit water from penetrating into the bonding interface to thereby prevent the sheet from peeling off upon washing with water. In general, the pressure-sensitive adhesive layer is formed on one side of the sheet for forming a burned pattern.

Preferred pressure-sensitive adhesive substances for use in forming the pressure-sensitive adhesive layer or the inner pressure-sensitive adhesive layer from the standpoints of low-temperature decomposability, freedom from the generation of carbonaceous residues upon burning, etc. are those which comprise as the main component a methacrylic acid polymer formed mainly from one or more methacrylic esters and have a glass transition temperature (Tg) of 30° C. or lower. Especially preferred are methacrylic acid polymers having a methacrylic ester content of 80% by weight or higher and a Tg of −20° C. or lower.

Examples of methacrylic esters which can be used for forming the methacrylic acid polymer include n-butyl methacrylate (Tg: 20° C.), n-hexyl methacrylate (Tg: −5° C.), n-octyl methacrylate (Tg: −20° C.), lauryl methacrylate (Tg: −65° C.), and hydroxypropyl methacrylate (Tg: 26° C.). Polymers other than the methacrylic acid polymers each formed mainly from one or more methacrylic esters cannot satisfy the desired requirements, i.e., low-temperature decomposability and freedom from the generation of carbonaceous residues, even though these polymers satisfy the requirement that the Tg is 30° C. or lower.

The methacrylic acid polymer may be one formed from one or more methacrylic esters. It may contain comonomer components, e.g., methacrylic acid, acrylic acid, and other vinyl monomers, so long as it satisfies the above-mentioned requirements including a Tg of 30° C. or lower.

In forming the pressure-sensitive adhesive layer or inner pressure-sensitive adhesive layer, the methacrylic acid polymer may be used in the form of an ordinary pressure-sensitive adhesive composition or the like. Especially preferred is a pressure-sensitive adhesive composition containing a liquid substance volatilizable at low temperature from the standpoints of improving pressure-sensitive adhesive properties, etc. An appropriate liquid substance compatible with the methacrylic acid polymer may be used, such as DOP, DBP, xylene oil, or terpene oil.

For forming the outer pressure-sensitive adhesive layer having resistance to water washing, there can be used a pressure-sensitive adhesive substance having such a property that when an outer pressure-sensitive adhesive layer is formed therefrom on a slide glass, allowed to stand for about 10 minutes, and then immersed for 10 minutes in water having room temperature, it does not suffer the peeling at an edge, etc. caused by water penetration. Consequently, an appropriate pressure-sensitive adhesive substance may be used, such as a rubber-based pressure-sensitive adhesive, an acrylic pressure-sensitive adhesive other than the pressure-sensitive substances shown hereinabove as examples with regard to the pressure-sensitive adhesive layer or inner pressure-sensitive adhesive layer, a vinyl alkyl ether type pressure-sensitive adhesive, or a silicone pressure-sensitive adhesive. A hydrophilic or water-repellent one or the like is also usable.

Examples of the rubber-based pressure-sensitive adhesive include those comprising a rubber polymer, such as a natural rubber, polyisoprene rubber, styrene/butadiene rubber, styrene/isoprene/styrene block copolymer rubber, styrene/butadiene/styrene block copolymer rubber, regenerated rubber, butyl rubber, polyisobutylene, or NBR, as a base polymer and, added thereto according to need, a tackifier resin such as a petroleum resin, terpene resin, rosin resin, xylene resin, coumarone-indene resin, phenolic resin, xylene resin, or alkyd resin, a softener, an antioxidant, a colorant, a filler, etc.

Examples of the acrylic pressure-sensitive adhesive include those comprising as a base polymer an acrylic polymer formed from one or more of acrylic alkyl esters comprising acrylic and methacrylic esters having a linear or branched alkyl group having 4 to 18 carbon atoms, such as butyl, amyl, isoamyl, hexyl, heptyl, cyclohexyl, 2-ethylhexyl, octyl, isooctyl, nonyl, isononyl, decyl, undecyl, lauryl, tridecyl, tetradecyl, stearyl, or octadecyl, or comprising as a base polymer the acrylic polymer with which a modifying monomer has been copolymerized.

Examples of the modifying monomer include carboxyl-containing monomers such as acrylic acid, methacrylic acid, carboxyethyl acrylate, carboxypentyl acrylate, itaconic acid, maleic acid, fumaric acid, and crotonic acid; acid anhydride monomers such as maleic anhydride and itaconic anhydride; hydroxyl-containing monomers such as 2-hydroxyethyl (meth)acrylate, 2-hydroxypropyl (meth)acrylate, 4-hydroxybutyl (meth)acrylate, 6-hydroxyhexyl (meth) acrylate, 8-hydroxyoctyl (meth)acrylate, 10-hydroxydecyl (meth)acrylate, 12-hydroxylauryl (meth)acrylate, and (4-hydroxymethylcyclohexyl)methyl acrylate; monomers containing a sulfo group, such as styrenesulfonic acid, allylsulfonic acids, 2-(meth)acrylamido-2-methylpropanesulfonic acid, (meth) acrylamidopropanesulfonic acid, sulfopropyl (meth) acrylate, and (meth)acryloyloxynaphthalenesulfonic acid; monomers containing a phosphate group, such as 2-hydroxyethyl acryloylphosphate; (N-substituted) amide monomers such as (meth)acrylamide, N,N-dimethyl(meth) acrylamide, N-butyl(meth)acrylamide, N-methylol(meth) acrylamide, and N-methylolpropane(meth)acrylamide; alkylaminoalkyl (meth)acrylate monomers such as aminoethyl (meth)acrylate, N,N-dimethylaminoethyl (meth) acrylate, and t-butylaminoethyl (meth)acrylate; alkoxyalkyl (meth)acrylate monomers such as methoxyethyl (meth) acrylate and ethoxyethyl (meth)acrylate; maleimide monomers such as N-cyclohexylmaleimide, N-isopropylmaleimide, N-laurylmaleimide, and N-phenylmaleimide; itaconimide monomers such as N-methylitaconimide, N-ethylitaconimide, N-butylitaconimide, N-octylitaconimide, N-2-ethylhexylitaconimide, N-cyclohexylitaconimide, and N-laurylitaconimide; succinimide monomers such as N-(meth)acryloyloxymethylenesuccinimide, N-(meth) acryloyl–6-hydroxyhexamethylenesuccinimide, and N-(meth)acryloyl-8-hydroxyoctamethylenesuccinimide; acrylic alkyl ester monomers having a lower alkyl group such as ethyl or propyl; vinyl monomers such as vinyl acetate, vinyl propionate, N-vinylpyrrolidone, methylvinylpyrrolidone, vinylpyridine, vinylpiperidone, vinylpyrimidine, vinylpiperazine, vinylpyrazine, vinylpyrrole, vinylimidazole, vinyloxazole, vinylmorpholine, N-vinylcarboxamides, styrene, .-methylstyrene, and N-vinylcaprolactam; cyanoacrylate monomers such as acrylonitrile and methacrylonitrile; epoxy-containing acrylic monomers such as glycidyl (meth)acrylate; acrylic glycol esters such as polyethylene glycol (meth)acrylate, polypropylene glycol (meth) acrylate, methoxyethylene glycol (meth)acrylate, and methoxypolypropylene glycol (meth)acrylate; acrylic ester monomers such as tetrahydrofurfuryl (meth)acrylate, fluoro (meth)acrylates, silicone (meth)acrylates, and 2-methoxyethyl acrylate; and polyfunctional acrylate monomers such as hexanediol di(meth)acrylate, (poly)ethylene glycol di(meth)acrylate, (poly)propylene glycol di(meth) acrylate, neopentyl glycol di(meth)acrylate, pentaerythritol di(meth)acrylate, trimethylolpropane tri(meth)acrylate, pentaerythritol tri(meth)acrylate, dipentaerythritol hexa(meth) acrylate, epoxy acrylates, polyester acrylates, and urethane acrylates.

Various additives are also incorporated into the acrylic pressure-sensitive adhesive according to need. Examples thereof include tackifiers, plasticizers, softeners, fillers such as calcium carbonate and clay, pigments, colorants, and antioxidants. Furthermore, a crosslinking agent is incorporated according to need, such as a polyfunctional isocyanate crosslinking agent, such as tolylene diisocyanate, trimethylolpropane tolylene diisocyanate, or diphenylmethane triisocyanate, an epoxy crosslinking agent such as polyethylene glycol diglycidyl ether, diglycidyl ether, or trimethylolpropane triglycidyl ether, a melamine resin crosslinking agent, a metal salt crosslinking agent, a metal chelate crosslinking agent, an amino resin crosslinking agent, or a peroxide crosslinking agent.

On the other hand, examples of the hydrophilic pressure-sensitive adhesive include poly(vinyl alcohol) pressure-sensitive adhesives, polyvinylpyrrolidone pressure-sensitive adhesives, polyacrylamide pressure-sensitive adhesives, acrylic acid copolymer pressure-sensitive adhesives, cellulosic pressure-sensitive adhesives, and poly(vinyl methyl ether) pressure-sensitive adhesives. These pressure-sensitive adhesives comprise a water-soluble or hydrophilic polymer, such as poly(vinyl alcohol), polyvinylpyrrolidone, polyacrylamide, an acrylic acid copolymer, a cellulosic polymer, or poly(vinyl methyl ether), as a base polymer and, incorporated therein according to need, appropriate ingredients, e.g., a tackifier such as a glycerol, polyethylene glycol, a polyether polyol, polyoxyethylene phenol ether, or a polyoxyethylene alkylphenol ether, a crosslinking agent, and a filler.

Examples of the water-repellent adhesive include silicone pressure-sensitive adhesives.

Each pressure-sensitive adhesive layer may be formed by an appropriate method according to a method for forming ordinary pressure-sensitive adhesive tapes or the like. For example, use may be made of a method in which one or more given pressure-sensitive adhesives are applied with an appropriate coating machine to a ceramic green sheet layer on its side to be bonded to an adherend to thereby directly form a single pressure-sensitive adhesive layer or two or more superposed pressure-sensitive adhesive layers, or a method in which a single pressure-sensitive adhesive layer or two or more pressure-sensitive adhesive layers superposed in a given order are formed on a separator and then transferred to a ceramic green sheet layer.

The thickness of the pressure-sensitive adhesive layer to be formed can be determined according to the intended use, etc. However, from the standpoints of provisional bonding strength, the prevention of cracking, bubbling, etc. in the burned ceramic layer, etc., the thickness of the pressure-sensitive adhesive layer is preferably 1 to 50 μm, especially preferably 3 to 30 μm. The inner pressure-sensitive adhesive layer in the superposed constitution also may have the same thickness.

The thickness of the outer pressure-sensitive adhesive layer having resistance to washing with water is preferably 15 μm or smaller, especially preferably 3 μm, from the standpoints of, for example, preventing a color, in particular whiteness, and adhesion from being impaired by carbonaceous residues remaining after burning. From the standpoint of modifying the surface properties of the inner pressure-sensitive adhesive layer, the thickness of the outer pressure-sensitive adhesive layer is preferably 0.05 μm or larger, especially preferably 0.1 μm or larger.

Until the pressure-sensitive adhesive layer (of either single- or multilayer constitution) described above is put to practical use, it is preferably kept being protected by, for example, provisionally bonding a separator thereto.

The sheet for forming a burned pattern of the present invention can be advantageously used for, for example, forming a burned label or the like. The burned label can be obtained boy, for example, a method comprising imparting a pattern comprising a heat-resistant ink to the sheet for forming a burned pattern formation on the ceramic green sheet layer side. The burned label obtained has a light reflectance (633 nm) of 60% or higher.

The heat-resistant ink can be obtained, for example, as a flowable material, e.g., a paste, by mixing one or more inorganic colorants with a solvent, if desired together with appropriate additives, e.g, a ceramic powder, an organic binder, a plasticizer, and a dispersant, by means of a ball mill or the like. Typical examples of the heat-resistant ink therefore include conventional pasty inks obtained by, for example, mixing either a combination of a glass powder and optional ingredients including an inorganic pigment or a colored glass pigment alone with a binder.

When used as a label or the like to be burned, the sheet for forming a burned pattern is provisionally bonded to an adherend through its pressure-sensitive adhesive layer or, in the case of the multilayer type, through the outer pressure-sensitive adhesive layer. The provisionally bonded sheet is washed with water if desired and necessary, before being subjected to burning. The burning may be conducted by an appropriate heating method according to the burning temperature of the ceramic green sheet layer, etc. For Braun tubes and the like, a heating temperature of 400 to 470° C. is usually used.

In the burning, the pressure-sensitive adhesive layer or the inner pressure-sensitive adhesive layer is pyrolyzed at relatively low temperature after the initiation of burning and thus disappears satisfactorily. Simultaneously therewith, the other organic ingredients including an organic binder disappear satisfactorily, and the inorganic particles such as glass particles in the ceramic green sheet layer cohere into a united mass to become a burned object tenaciously adhered to the adherend. In the case where the sheet has a pattern or the like made of a heat-resistant ink, the organic components in the ink disappear and, simultaneously therewith, the pattern or the like is united with the burned object which is being formed from the ceramic green sheet layer to thereby form a burned pattern.

It is thought that as stated hereinabove the organic components causative of carbonaceous residues such as carbon in the conventional sheets for forming a burned pattern are the organic binder contained in the ceramic green sheet and the pressure-sensitive adhesive layer. However, even when an organic binder or an outer pressure-sensitive adhesive layer having resistance to water washing which each has been causative of carbonaceous residues such as tar and carbon is used, the generation of such carbonaceous residues can be prevented by using a pressure-sensitive adhesive layer or inner pressure-sensitive adhesive layer decomposable at low temperature, as in the present invention. Namely, the use of a pressure-sensitive adhesive layer or inner pressure-sensitive adhesive layer which is decomposable at low temperature is effective in preventing the generation of carbonaceous residues attributable to the organic binder or outer pressure-sensitive adhesive layer and thus inhibiting the sheet as a whole from generating carbonaceous residues, although the reasons for this effect have not been elucidated in detail.

Therefore, the sheet for forming a burned pattern of the present invention can be used for various purposes, for example, for forming a display material, e.g., an identification label, or for decoration. The adherend to which the burned pattern or the like is to be imparted is not particularly limited, and may have any desired shape, e.g., a flat shape or a container shape. In particular, the sheet for forming a burned pattern of the present invention can be advantageously used for articles produced through a step in which articles bearing the sheet for forming a burned pattern in an unburned state provisionally bonded thereto are washed with water, because the sheet for forming a burned pattern provisionally bonded to ceramic articles, e.g., glasses, enameled wares, and tiles, does not peel off even upon water washing.

Examples and Comparative Examples are shown below.

EXAMPLE 1

In 125 parts (parts by weight; the same applies hereinafter) of ethyl acetate containing 1 part of azobisisobutyronitrile were solution-polymerized 495 parts of lauryl methacrylate and 5 parts of acrylic acid at 60° C. for 8 hours. Thereafter, a polyfunctional isocyanate (trimethylolpropane/hexamethylene diisocyanate adduct) was added to the resulting solution in an amount of 2 parts per 100 parts of the polymer (weight average molecular weight, 1,100,000) to prepare a pressure-sensitive adhesive. This adhesive was applied to a separator by the doctor blade method, and the coating was dried to form a pressure-sensitive adhesive layer having a thickness of 15 μm. The separator was one obtained by forming a silicone release coat on a glassine paper having a thickness of 70 μm (the same applies hereinafter).

On the other hand, 150 parts of a glass powder comprising $PbO.SiO_2B_2O_3.Al_2O_3$ as the main component and having an average particle diameter of 10 μm and 30 parts of a potassium titanate whisker powder were added to a toluene solution containing 100 parts of an acrylic binder having a weight average molecular weight of 100,000. The mixture was homogenized with a ball mill, subsequently spread on a separator by the doctor blade method, and then dried to form a ceramic green sheet layer having a thickness of 50 μm. The pressure-sensitive adhesive layer described above was bonded to this green sheet layer to obtain a sheet for forming a burned pattern.

Subsequently, a given bar code was printed on the ceramic green sheet of the sheet for forming a burned pattern with an ink ribbon and a thermal transfer printer to obtain a label to be burned. The ink ribbon was one obtained by adding 100 parts of a chromium oxide/cobalt oxide/iron oxide/lmanganese oxide black pigment (average particle diameter, 0.5 μm) to a xylene solution containing 100 parts of polydimethylsiloxane having a weight average molecular weight of 100,000, homogenizing this mixture, applying the resulting heat-resistant ink with a gravure coater to a polyester film having a thickness of 6 μm, and drying the coating to form an ink layer having a thickness of 6 μm.

EXAMPLE 2

A sheet for forming a burned pattern and a label to be burned were obtained in the same manner as in Example 1, except that a combination of 300 parts of lauryl methacrylate and 195 parts of butyl methacrylate was used in place of the combination of 495 parts of lauryl methacrylate and 5 parts of acrylic acid to obtain a polymer having a weight average molecular weight of 500,000, and that this polymer was used.

COMPARATIVE EXAMPLE 1

A sheet for forming a burned pattern and a label to be burned were obtained in the same manner as in Example 1, except that 500 parts of butyl acrylate was used in place of the combination of 495 parts of lauryl methacrylate and 5 parts of acrylic acid to obtain a polymer having a weight average molecular weight of 1,300,000, and that this polymer was used.

EVALUATION TEST

The separator was peeled from each of the labels to be burned obtained in Examples 1 and 2 and Comparative Example 1. These labels each were provisionally bonded to a glass plate through the pressure-sensitive adhesive layer and then burned. The burning was conducted in the air under such conditions that the glass plate bearing the label was heated from room temperature to 440° C. at a heating rate of 10° C./min, subsequently kept at this temperature for 12 minutes, and then cooled to room temperature at a cooling rate of 10° C./min.

The thus-obtained burned labels which each was tenaciously adhered to the glass plate and had a black bar code pattern on a white background were examined for the light reflectance (633 nm) of the white background. The burned labels were further examined for label adhesion by a method in which edge parts of the burned label were strongly rubbed with a fingernail.

The results of the above evaluations are shown in Table 1.

TABLE 1

| | Example 1 | Example 2 | Comparative Example 1 |
|---|---|---|---|
| Light reflectance | 70% | 65% | 52% |
| Adhesion | Unable to be peeled off | Unable to be peeled off | Easy to peel off |

In each of the burned labels obtained in the Examples, the black bar code pattern formed on a white background was a highly clear pattern. The low light reflectance and the poor adhesion in the Comparative Example were attributable to carbonaceous residues such as tar and carbon.

REFERENCE EXAMPLE 1

In 125 parts (parts by weight; the same applies hereinafter) of ethyl acetate containing 1 part of azobisisobutyronitrile were solution-polymerized 100 parts of butyl acrylate and 10 parts of acrylic acid at 60° C. for 8 hours. Thereafter, a polyfunctional isocyanate (trimethylolpropane/hexamethylene diisocyanate adduct) was added to the resulting solution in an amount of 2 parts per 100 parts of the polymer to prepare pressure-sensitive adhesive A.

REFERENCE EXAMPLE 2

In the same manner as in Reference Example 1, lauryl methacrylate was polymerized and the resulting homopolymer was used to prepare pressure-sensitive adhesive B.

REFERENCE EXAMPLE 3

In the same manner as in Reference Example 1, stearyl methacrylate was polymerized and the resulting homopolymer was used to prepare pressure-sensitive adhesive C.

REFERENCE EXAMPLE 4

In the same manner as in Reference Example 1, 2-ethylhexyl methacrylate was polymerized and the resulting homopolymer was used to prepare pressure-sensitive adhesive D.

REFERENCE EXAMPLE 5

Natural-rubber pressure-sensitive adhesive E was used.

REFERENCE EXAMPLE 6

In the same manner as in Reference Example 1, 100 parts of butyl acrylate was copolymerized with 3 parts of acrylic acid and the resultant copolymer was used to prepare pressure-sensitive adhesive F.

EXAMPLE 3

Pressure-sensitive adhesive A, obtained in Reference Example 1, was diluted with ethyl acetate to a concentration of 2%. This solution was applied by the doctor blade method to a separator obtained by forming a silicone release coat on a polyester film having a thickness of 38 μm. The coating was dried to form an outer pressure-sensitive adhesive layer having a thickness of 3 μm. Pressure-sensitive adhesive B, obtained in Reference Example 2, was directly applied to the outer pressure-sensitive adhesive layer and then dried to form an inner pressure-sensitive adhesive layer having a thickness of 12 μm. Thus, laminated pressure-sensitive adhesive layers were obtained.

On the other hand, 150 parts of a glass powder comprising $PbO.SiO_2.B_2O_3.Al_2O_3$ as the main component and having an average particle diameter of 10 μm and 30 parts of a potassium titanate whisker powder were added to a toluene solution containing 100 parts of an acrylic binder having a weight average molecular weight of 100,000. The mixture was homogenized with a ball mill, subsequently spread on a separator by the doctor blade method, and then dried to form a ceramic green sheet layer having a thickness of 50 μm. The laminated pressure-sensitive adhesive layers described above were bonded to this green sheet layer to obtain a sheet for forming a burned pattern. The separator was one obtained by forming a silicone release coat on a glassine paper having a thickness of 70 μm.

Subsequently, a given bar code was printed on the ceramic green sheet of the sheet for forming a burned pattern with an ink ribbon and a thermal transfer printer to obtain a label to be burned. The ink ribbon was one obtained by adding 100 parts of a chromium oxide/cobalt oxide/iron oxide/manganese oxide black pigment (average particle diameter, 0.5 μm) to a xylene solution containing 100 parts of polydimethylsiloxane having a weight average molecular weight of 100,000, homogenizing this mixture, applying the resulting heat-resistant ink with a gravure coater to a polyester film having a thickness of 6 μm, and drying the coating to form an ink layer having a thickness of 6 μm.

EXAMPLE 4

A sheet for forming a burned pattern and a label to be burned were obtained in the same manner as in Example 3, except that an inner pressure-sensitive adhesive layer was formed from pressure-sensitive adhesive C obtained in Reference Example 3.

EXAMPLE 5

A sheet for forming a burned pattern and a label to be burned were obtained in the same manner as in Example 3, except that an inner pressure-sensitive adhesive layer was formed from pressure-sensitive adhesive D obtained in Reference Example 4.

EXAMPLE 6

A sheet for forming a burned pattern and a label to be burned were obtained in the same manner as in Example 3, except that an outer pressure-sensitive adhesive layer was formed from pressure-sensitive adhesive E obtained in Reference Example 5.

EXAMPLE 7

A sheet for forming a burned-pattern and a label to be burned were obtained in the same manner as in Example 4, except that an outer pressure-sensitive adhesive layer was formed from pressure-sensitive adhesive E obtained in Reference Example 5.

EXAMPLE 8

A sheet for forming a burned pattern and a label to be burned were obtained in the same manner as in Example 5, except that an outer pressure-sensitive adhesive layer was formed from pressure-sensitive adhesive E obtained in Reference Example 5.

EXAMPLE 9

A sheet for forming a burned pattern and a label to be burned were obtained in the same manner as in Example 3, except that an outer pressure-sensitive adhesive layer was formed from pressure-sensitive adhesive F obtained in Reference Example 6.

EXAMPLE 10

A sheet for forming a burned pattern and a label to be burned were obtained in the same manner as in Example 4, except that an outer pressure-sensitive adhesive layer was formed from pressure-sensitive adhesive F obtained in Reference Example 6.

EXAMPLE 11

A sheet for forming a burned pattern and a label to be burned were obtained in the same manner as in Example 5, except that an outer pressure-sensitive adhesive layer was formed from pressure-sensitive adhesive F obtained in Reference Example 6.

COMPARATIVE EXAMPLE 2

A sheet for forming a burned-pattern and a label to be burned were obtained in the same manner as in Example 3, except that laminated pressure-sensitive adhesive layers were formed by forming an inner pressure-sensitive adhesive layer having a thickness of 3. m from pressure-sensitive adhesive A obtained in Reference Example 1, and forming an outer pressure-sensitive adhesive layer having a thickness of 12 μm from pressure-sensitive adhesive B obtained in Reference Example 2.

COMPARATIVE EXAMPLE 3

A sheet for forming a burned pattern and a label to be burned were obtained in the same manner as in Example 3, except that superposed pressure-sensitive adhesive layers were formed by forming an inner pressure-sensitive adhesive layer having a thickness of 3 μm from pressure-sensitive adhesive E obtained in Reference Example 5, and forming an outer pressure-sensitive adhesive layer having a thickness of 12 μm from pressure-sensitive adhesive B obtained in Reference Example 2.

COMPARATIVE EXAMPLE 4

A sheet for forming a burned-pattern and a label to be burned were obtained in the same manner as in Example 3, except that laminated pressure-sensitive adhesive layers were formed by forming an inner pressure-sensitive adhesive layer having a thickness of 3 μm from pressure-sensitive adhesive F obtained in Reference Example 6, and forming an outer pressure-sensitive adhesive layer having a thickness of 12 μm from pressure-sensitive adhesive B obtained in Reference Example 2.

COMPARATIVE EXAMPLE 5

A sheet for forming a burned pattern formation and a label to be burned were obtained in the same manner as in Example 3, except that laminated pressure-sensitive adhesive layers were formed by forming an inner pressure-sensitive adhesive layer having a thickness of 12 μm from pressure-sensitive adhesive A obtained in Reference Example 1, and forming an outer pressure-sensitive adhesive layer having a thickness of 3 μm from pressure-sensitive adhesive B obtained in Reference Example 2.

COMPARATIVE EXAMPLE 6

A sheet for forming a burned pattern and a label to be burned were obtained in the same manner as in Example 3, except that laminated pressure-sensitive adhesive layers were formed by forming an inner pressure-sensitive adhesive layer having a thickness of 12 μm from pressure-sensitive adhesive E obtained in Reference Example 5, and forming an outer pressure-sensitive adhesive layer having a thickness of 3 μm from pressure-sensitive adhesive B obtained in Reference Example 2.

COMPARATIVE EXAMPLE 7

A sheet for forming a burned pattern and a label to be burned were obtained in the same manner as in Example 3, except that laminated pressure-sensitive adhesive layers were formed by forming an inner pressure-sensitive adhesive layer having a thickness of 12 μm from pressure-sensitive adhesive F obtained in Reference Example 6, and forming an outer pressure-sensitive adhesive layer having a thickness of 3 μm from pressure-sensitive adhesive B obtained in Reference Example 2.

COMPARATIVE EXAMPLE 8

A sheet for forming a burned pattern and a label to be burned were obtained in the same manner as in Example 3, except that laminated pressure-sensitive adhesive layers were formed by forming an inner pressure-sensitive adhesive layer having a thickness of 3 μm from pressure-sensitive adhesive B obtained in Reference Example 2, and forming an outer pressure-sensitive adhesive layer having a thickness of 12 μm from pressure-sensitive adhesive A obtained in Reference Example 1.

COMPARATIVE EXAMPLE 9

A sheet for forming a burned pattern and a label to be burned were obtained in the same manner as in Example 3, except that laminated pressure-sensitive adhesive layers were formed by forming an inner pressure-sensitive adhesive layer having a thickness of 3 μm from pressure-sensitive adhesive B obtained in Reference Example 2, and forming an outer pressure-sensitive adhesive layer having a thickness of 12 μm from pressure-sensitive adhesive E obtained in Reference Example 5.

COMPARATIVE EXAMPLE 10

A sheet for forming a burned pattern and a label to be burned were obtained in the same manner as in Example 3, except that laminated pressure-sensitive adhesive layers were formed by forming an inner pressure-sensitive adhesive layer having a thickness of 3 μm from pressure-sensitive adhesive B obtained in Reference Example 2, and forming an outer pressure-sensitive adhesive layer having a thickness of 12 μm from pressure-sensitive adhesive F obtained in Reference Example 6.

COMPARATIVE EXAMPLE 11

A sheet for forming a burned pattern and a label to be burned were obtained in the same manner as in Example 3, except that laminated pressure-sensitive adhesive layers were formed by forming an inner pressure-sensitive adhesive layer having a thickness of 12 μm from pressure-sensitive adhesive A obtained in Reference Example 1, and forming an outer pressure-sensitive adhesive layer having a thickness of 3 μm from pressure-sensitive adhesive E obtained in Reference Example 5.

COMPARATIVE EXAMPLE 12

A sheet for forming a burned pattern and a label to be burned were obtained in the same manner as in Example 3, except that laminated pressure-sensitive adhesive layers were formed by forming an inner pressure-sensitive adhesive layer having a thickness of 12 μm from pressure-sensitive adhesive E obtained in Reference Example 5, and forming an outer pressure-sensitive adhesive layer having a thickness of 3 μm from pressure-sensitive adhesive A obtained in Reference Example 1.

COMPARATIVE EXAMPLE 13

A sheet for forming a burned pattern and a label to be burned were obtained in the same manner as in Example 3, except that laminated pressure-sensitive adhesive layers were formed by forming an inner pressure-sensitive adhesive layer having a thickness of 3 μm from pressure-sensitive adhesive A obtained in Reference Example 1, and forming an outer pressure-sensitive adhesive layer having a thickness of 12 μm from pressure-sensitive adhesive E obtained in Reference Example 5.

COMPARATIVE EXAMPLE 14

A sheet for forming a burned pattern and a label to be burned were obtained in the same manner as in Example 3, except that superposed pressure-sensitive adhesive layers were formed by forming an inner pressure-sensitive adhesive layer having a thickness of 3 μm from pressure-sensitive adhesive E obtained in Reference Example 5, and forming an outer pressure-sensitive adhesive layer having a thickness of 12 μm from pressure-sensitive adhesive A obtained in Reference Example 1.

COMPARATIVE EXAMPLE 15

A sheet for forming a burned pattern and a label to be burned were obtained in the same manner as in Example 3, except that laminated pressure-sensitive adhesive layers were formed by forming an inner pressure-sensitive adhesive layer having a thickness of 12 μm from pressure-sensitive adhesive B obtained in Reference Example 2, and forming an outer pressure-sensitive adhesive layer having a thickness of 3 μm from pressure-sensitive adhesive C obtained in Reference Example 3.

COMPARATIVE EXAMPLE 16

A sheet for forming a burned pattern and a label to be burned were obtained in the same manner as in Example 3, except that laminated pressure-sensitive adhesive layers were formed by forming an inner pressure-sensitive adhesive layer having a thickness of 12 μm from pressure-sensitive adhesive C obtained in Reference Example 3, and forming an outer pressure-sensitive adhesive layer having a thickness of 3 μm from pressure-sensitive adhesive B obtained in Reference Example 2.

COMPARATIVE EXAMPLE 17

A sheet for forming a burned pattern and a label to be burned were obtained in the same manner as in Example 3, except that laminated pressure-sensitive adhesive layers were formed by forming an inner pressure-sensitive adhesive layer having a thickness of 12 μm from pressure-sensitive adhesive D obtained in Reference Example 4, and forming an outer pressure-sensitive adhesive layer having a thickness of 3 μm from pressure-sensitive adhesive B obtained in Reference Example 2.

COMPARATIVE EXAMPLE 18

A sheet for forming a burned pattern and a label to be burned were obtained in the same manner as in Example 3, except that laminated pressure-sensitive adhesive layers were formed by forming an inner pressure-sensitive adhesive layer having a thickness of 3 μm from pressure-sensitive adhesive B obtained in Reference Example 2, and forming an outer pressure-sensitive adhesive layer having a thickness of 12 μm from pressure-sensitive adhesive C obtained in Reference Example 3.

COMPARATIVE EXAMPLE 19

A sheet for forming a burned pattern and a label to be burned were obtained in the same manner as in Example 3, except that laminated pressure-sensitive adhesive layers were formed by forming an inner pressure-sensitive adhesive layer having a thickness of 3 μm from pressure-sensitive adhesive B obtained in Reference Example 2, and forming an outer pressure-sensitive adhesive layer having a thickness of 12 μm from pressure-sensitive adhesive D obtained in Reference Example 4.

EVALUATION TEST

The labels obtained in Examples 3 to 11 and Comparative Examples 2 to 19 were examined for the following properties by a method in which the separator was peeled from each label and the label was provisionally bonded through the pressure-sensitive adhesive layer.

PROVISIONAL BONDABILITY

Each label to be burned was contact-bonded to a satinized glass surface having a surface roughness $R_a$ of 0.11 mm to examine the adhesion thereof. The labels which were tightly adhered were judged good, while those which were easily peeled off were judged poor.

RESISTANCE TO WATER WASHING

Each label was provisionally bonded to a slide glass, and the glass bearing the label was allowed to stand for 10 minutes, subsequently immersed in room-temperature water for 2 hours, taken out therefrom, and then examined for label adhesion. The labels which were tightly adhered were judged good, while those which were easily peeled off were judged poor.

ADHESION AFTER BURNING

Each label was provisionally bonded to a slide glass and burned in the air under such conditions that the glass bearing the label was heated from room temperature to 440° C. at a heating rate of 10° C./min, kept at this temperature for 12 minutes, and then cooled to room temperature at a cooling rate of 10° C./min. The burned labels were examined for adhesion. The burned labels which were tenaciously adhered were judged good, while those which were easily peeled off were judged poor.

WHITENESS (COLOR RETENTION)

The burned labels obtained through the above burning treatment, which each had a black bar code pattern on a white background, were examined for the light reflectance (633 nm) of the white background. The burned labels having a reflectance of 60% or higher were judged good, while those having a reflectance lower than 60% were judged poor.

The results of the above evaluations are shown in Table 2.

TABLE 2

| | Kind of inner pressure-sensitive adhesive layer | Kind of outer pressure-sensitive adhesive layer | Provisional bond-ability | Resistance to water washing | Adhesion after burning | Whiteness |
|---|---|---|---|---|---|---|
| Example 3 | B | A | good | good | good | good |
| Example 4 | C | A | good | good | good | good |
| Example 5 | D | A | good | good | good | good |
| Example 6 | B | E | good | good | good | good |
| Example 7 | C | E | good | good | good | good |
| Example 8 | D | E | good | good | good | good |
| Example 9 | B | F | good | good | good | good |
| Example 10 | C | F | good | good | good | good |
| Example 11 | D | F | good | good | good | good |
| Comparative Example 2 | A | B | good | poor | good | good |
| Comparative Example 3 | E | B | good | poor | good | good |
| Comparative Example 4 | F | B | good | poor | good | good |
| Comparative Example 5 | A | B | good | poor | poor | poor |
| Comparative Example 6 | E | B | good | poor | good | poor |
| Comparative Example 7 | F | B | good | poor | poor | poor |
| Comparative Example 8 | B | A | good | good | poor | poor |
| Comparative Example 9 | B | E | good | good | good | poor |
| Comparative Example 10 | B | F | good | good | poor | poor |
| Comparative Example 11 | A | E | good | good | poor | poor |
| Comparative Example 12 | E | A | good | good | good | poor |
| Comparative Example 13 | A | E | good | good | good | poor |
| Comparative Example 14 | E | A | good | good | poor | poor |
| Comparative Example 15 | B | C | good | poor | good | good |
| Comparative Example 16 | C | B | good | poor | good | good |
| Comparative Example 17 | D | B | good | poor | good | good |

TABLE 2-continued

| | Kind of inner pressure-sensitive adhesive layer | Kind of outer pressure-sensitive adhesive layer | Provisional bond-ability | Resistance to water washing | Adhesion after burning | Whiteness |
|---|---|---|---|---|---|---|
| Comparative Example 18 | B | C | good | poor | good | good |
| Comparative Example 19 | B | D | good | poor | good | good |

In each of the burned labels obtained in the Examples, the black bar code pattern formed on a white background was a highly clear pattern. The poor adhesion after burning and the poor whiteness in the Comparative Examples were attributable to carbonaceous residues such as carbon and tar.

POSSIBILITY OF INDUSTRIAL APPLICATION

As described above, the sheet for forming a burned pattern of the present invention is decreased in the formation of carbonaceous residues through burning and is excellent in the retention of a colored state, e.g., whiteness, and in adhesion after burning to the adherend, etc. Furthermore, the sheet for forming a burned pattern of the invention which has been provisionally bonded in an unburned state is less apt to peel off the adherend even when washed with water.

What is claimed is:

1. A sheet for forming a burned pattern comprising a ceramic green sheet layer to be burned and a pressure-sensitive adhesive layer, wherein the pressure-sensitive adhesive layer comprises a methacrylic acid polymer having a methacrylic ester content of 80% by weight or higher and a glass transition temperature of 30° C. or lower, and leaves a decreased amount of carbonaceous residues after burning.

2. The sheet for forming a burned pattern as claimed in claim 1, wherein said methacrylic acid polymer has a glass transition temperature of −20° C. or lower.

3. A sheet for forming a burned pattern comprising a ceramic green sheet layer to be burned and a pressure-sensitive adhesive layer, wherein the pressure-sensitive adhesive layer comprises a laminated layer comprising at least two of an inner pressure-sensitive adhesive layer which comprises a methacrylic acid polymer having a methacrylic ester content of 80% by weight or higher and a glass transition temperature of 30° C. or lower and leaves a decreased amount of carbonaceous residues after burning and an outer pressure-sensitive adhesive layer having resistance to water washing.

4. The sheet for forming a burned pattern as claimed in claim 3, wherein the inner pressure-sensitive layer has a thickness of from 3 to 30 μm, and the outer pressure-sensitive adhesive layer has a thickness of 15 μm or lower.

5. The sheet for forming a burned pattern as claimed in claim 3, wherein said methacrylic acid polymer has a glass transition temperature of −20° C. or lower.

* * * * *